United States Patent [19]

Ferguson

[11] Patent Number: 4,592,732

[45] Date of Patent: Jun. 3, 1986

[54] MARINE PROPULSION DEVICE POWER STEERING SYSTEM

[75] Inventor: Arthur R. Ferguson, Northbrook, Ill.

[73] Assignee: Outboard Marine Corporation, Waukegan, Ill.

[21] Appl. No.: 614,815

[22] Filed: May 29, 1984

Related U.S. Application Data

[63] Continuation-in-part of Ser. No. 605,141, Apr. 30, 1984, Pat. No. 4,545,770, which is a continuation of Ser. No. 293,324, Aug. 17, 1981, Pat. No. 4,449,945.

[51] Int. Cl.[4] ..... B63H 21/26

[52] U.S. Cl. ..... 440/61; 440/63; 114/150

[58] Field of Search ..... 440/42, 43, 53, 57–63, 440/900; 114/144 R, 150; 248/640–643; 74/480 B

[56] References Cited

U.S. PATENT DOCUMENTS

| | | | |
|---|---|---|---|
| 2,479,063 | 8/1949 | Forsythe | 114/150 |
| 2,892,310 | 6/1959 | Mercier | 60/51 |
| 2,916,008 | 12/1959 | Bauer | 440/61 |
| 2,939,417 | 6/1960 | Hammock | 114/150 |
| 3,091,977 | 6/1963 | Kiekhaefer | 440/62 |
| 3,302,604 | 2/1967 | Stuteville | 114/150 |
| 3,384,046 | 5/1968 | Stuteville | 114/150 |
| 3,631,833 | 1/1972 | Shimanckas | 440/55 |
| 3,774,568 | 11/1973 | Borst et al. | 114/144 R |
| 3,913,517 | 10/1975 | Lohse et al. | 440/61 |
| 4,054,102 | 10/1977 | Borst et al. | 114/144 R |
| 4,227,481 | 10/1980 | Cox et al. | 440/61 |
| 4,295,833 | 10/1981 | Borst | 440/61 |
| 4,362,515 | 12/1982 | Ginnow | 440/62 |
| 4,373,920 | 2/1983 | Hall et al. | 440/59 |
| 4,419,084 | 12/1983 | Borst | 440/58 |
| 4,449,945 | 5/1984 | Ferguson | 440/61 |

FOREIGN PATENT DOCUMENTS

| | | | |
|---|---|---|---|
| 526093 | 12/1982 | Australia . | |
| 953085 | 3/1964 | United Kingdom | 114/150 |
| 1214853 | 12/1970 | United Kingdom | 440/61 |

*Primary Examiner*—Trygve M. Blix
*Assistant Examiner*—Stephen P. Avila
*Attorney, Agent, or Firm*—Michael, Best & Friedrich

[57] ABSTRACT

A marine propulsion device adapted for mounting to a boat transom and comprising a propulsion unit, a swivel bracket connecting the propulsion unit to the boat transom for pivotal movement of the propulsion unit relative to the boat transom about a steering axis, and an extendable and contactable steering link pivotally connected to the boat transom and to the propulsion unit for rotating the propulsion unit about the steering axis. The device also comprises an operator actuated extendable and contractable control link connected to the boat transom and to the propulsion unit and operably connected to the steering link for selectively effecting extension and contraction of the steering link in response to operator actuation of the control link.

25 Claims, 5 Drawing Figures

MARINE PROPULSION DEVICE POWER STEERING SYSTEM

RELATED APPLICATION

This application is a continuation-in-part of U.S. patent application Ser. No. 605,141 filed Apr. 30, 1984, now U.S. Pat. No. 4,545,770, issued Oct. 8, 1985, which application is a continuation of U.S. patent application Ser. No. 293,324, filed by Arthur R. Ferguson on Aug. 17, 1981 and entitled "Outboard Motor Mounting Arrangement, now U.S. Pat. No. 4,449,945 issued May 22, 1984.

BACKGROUND OF THE INVENTION

The invention relates to arrangements for steering the propulsion unit of a marine propulsion device. Attention is directed to the following U.S. Patents:

Shimanckas, No. 3,631,833, issued Jan. 4, 1972
Borst, No. 3,774,568, issued Nov. 27, 1973
Borst, No. 4,054,102, issued Oct. 18, 1977
Hammock No. 2,939,417, issued June 7, 1960
Hall et al. No. 4,373,920, issued Feb. 15, 1983
Mercier, No. 2,892,310, issued June 30, 1959
Lohse, No. 3,913,517, issued Oct. 21, 1975
Forsythe, No. 2,479,063, issued Aug. 16, 1949
Stuteville, No. 3,302,604, issued Feb. 7, 1967
Stuteville, No. 3,384,046, issued May 21, 1968
Borst, No. 4,295,833, issued Oct. 20, 1981
Borst, No. 4,419,084, issued Dec. 6, 1983

Also, attention is directed to British Pat. No. 1,214,853.

Also, attention is directed to co-pending Hall application Ser. No. 484,900, filed Apr. 14, 1983, and entitled "Marine Propulsion Steering Assist Device."

Also, attention is directed to co-pending Hall et al. application Ser. No. 485,028, filed Apr. 14, 1983, now abandoned, and entitled "Marine Propulsion Steering Assist Device."

Also, attention is directed to co-pending Hall application Ser. No. 558,041, filed Dec. 5, 1983, and entitled "Hydraulic Assistance Device For Use In A Steering System."

Also, attention is directed to co-pending Bland et al. application Ser. No. 524,749, filed Aug. 19, 1983 and entitled "Steering Mechanism."

SUMMARY OF THE INVENTION

The invention provides a marine propulsion device adapted for mounting to a boat transom and comprising a propulsion unit, means connecting the propulsion unit to the boat transom for pivotal movement of the propulsion unit relative to the boat transom about a steering axis, and means for rotating the propulsion unit about the steering axis. The rotating means include an extendible and contractable steering link pivotally connected to the boat transom and to the propulsion unit, and means for selectively and alternatively extending and contracting the steering link, the means including operator actuated extendible and contractable control means connected to the boat transom and to the propulsion unit and operably connected to the steering link for selectively effecting extension and contraction of the steering link in response to operator actuation of the control means.

The invention also provides a marine propulsion device adapted for mounting to a boat transom and comprising a propulsion unit, means connecting the propulsion unit to the boat transom for pivotal movement of the propulsion unit relative to the boat transom about a steering axis, and means for rotating the propulsion unit about the steering axis. The rotating means includes a steering arm fixedly attached to the propulsion unit for rotation therewith about the steering axis, the steering arm having opposite first and second ends and being attached to the propulsion unit at a point on the steering arm intermediate the opposite ends. The rotating means also includes an extendible and contractable steering link pivotally connected to the first end of the steering arm and to the boat transom, and means for selectively and alternatively extending and contracting the link, the means including operator actuated extendible and contractable control means connected to the second end of the steering arm and to the boat transom and operably connected to the link for selectively effecting extension and contraction of the steering link in response to operator actuation of the control means.

The invention also provides a marine propulsion device adapted for mounting to a boat transom and comprising a swivel bracket, means connecting the swivel bracket to the boat transom for pivotal movement of the swivel bracket relative to the transom about a horizontal tilt axis, a propulsion unit, means connecting the propulsion unit to the swivel bracket for common movement of the propulsion uith the swivel bracket about the tilt axis and for pivotal movement of the propulsion unit relative to the swivel bracket about a steering axis transverse to the tilt axis, the means including a king pin extending in the swivel bracket and fixed to the propulsion unit for rotation therewith about the steering axis, and means rotating the propulsion unit about the steering axis. The rotating means includes a steering arm fixedly attached to the king pin for rotation therewith about the steering axis, the steering arm having opposite first and second ends and being attached to the king pin at a point on the steering arm intermediate the opposite ends. The rotating means also includes extendible and contractable hydraulic steering means having one end pivotally connected to the swivel bracket and an opposite end pivotally connected to the first end of the steering arm and having first and second fluid ports, the hydraulic steering means extending in response to fluid entering the first port and retracting in response to fluid entering the second port. The rotating means further includes means for selectively and alternatively extending and contracting the hydraulic steering means, the means including extendible and contractable control means connected between the swivel bracket and the second end of the steering arm and operably connected to the hydraulic steering means for selectively controlling the supplying of hydraulic fluid to the first and second ports and the draining of fluid from the first and second ports.

In one embodiment, the control means comprises a first member pivotally connected to the propulsion unit or second end of the steering arm, a second member pivotally connected to the boat transom, the second member being movably connected to the first member and being movable relative to the first member between first, second, and third positions, and operator actuated means for moving the second member relative to the first member. The control means causes the link to extend when the second member is in the first position, causes the link to contract when the second member is in the second position, and causes the link to neither extend nor contract when the second member is in the third position.

In one embodiment, the steering link comprises extendible and contractable hydraulic steering means having one end pivotally connected to the propulsion unit or first end of the steering arm and an opposite end pivotally connected to the boat transom and having first and second fluid ports, the hydraulic steering means extending in response to fluid entering the first port and contracting in response to fluid entering the second port. The control means controls the supplying of hydraulic fluid to the first and second ports and the draining of hydraulic fluid from the first and second ports.

In one embodiment, the control means comprises a first source of fluid under pressure, and valve means communicating with the first fluid source. The valve means comprises a first conduit communicating with the first port of the hydraulic cylinder, a second conduit communicating with the second port of the hydraulic cylinder, a valve housing pivotally connected to the propulsion unit or second end of the steering arm, and a valve member housed in the valve housing and movable relative to the valve housing between first, second and third positions. The valve means provides communication of the first fluid source with the first conduit when the valve member is in the first position, provides communication of the first fluid source with the second conduit when the valve member is in the second position, and provides communication of the first fluid source with both of the first and second conduits when the valve member is in the third position. The control means further comprises operator actuated means for moving the valve member relative to the valve housing.

In one embodiment, the control means comprises a first source of fluid under pressure, valve means communicating with the first fluid source and comprising a first conduit communicating with the first port of the hydraulic steering means, a second conduit communicating with the second port of the hydraulic steering means, a valve housing pivotally connected to the propulsion unit or the second end of the steering arm, and a valve member housed in the valve housing and movable relative to the valve housing between first, second and third positions, the valve means providing communication of the first fluid source with the first conduit when the valve member is in the first position, providing communication of the first fluid source with the second conduit when the valve member is in the second position, and providing communication of the first fluid source with neither of the first and second conduits when the valve member is in the third position, and operator actuated means for moving the valve member relative to the valve housing.

In one embodiment, the hydraulic steering means comprises a hydraulic cylinder pivotally connected to the swivel bracket and having first and second fluid ports, and a piston rod having one end slidably received in the cylinder and an opposite end pivotally connected to the first end of the steering arm, the piston rod extending in response to fluid entering the first port and retracting in response to fluid entering the second port.

In one embodiment, the hydraulic steering means comprises a cylinder having first and second closed ends, the first end being pivotally connected to the swivel bracket, and a piston movable in the cylinder and dividing the cylinder into a first pressure chamber adjacent the first end of the cylinder and a second pressure chamber adjacent the second end of said cylinder. The steering means also comprises a piston rod extending through the second end of the cylinder and having a first end fixedly attached to the piston and a second end pivotally connected to the first end of the steering arm, the piston rod including, adjacent the second end of the piston rod, the first and second fluid ports, and including passage means communicating between the first fluid port and the first pressure chamber, and passage means communicating between the second fluid port and the second pressure chamber.

In one embodiment, the operator actuated means comprises hydraulic activating means comprising a second hydraulic cylinder connected to the boat transom or swivel bracket and having first and second fluid ports, and a second piston rod having one end slidably received in the second cylinder and an opposite end connected to the valve member. The second piston rod extends in response to fluid entering the first port of the second cylinder and retracts in response to fluid entering the second port of the second cylinder. The operator actuated means also comprises operator actuated steering means including a second fluid source, pump means, a third conduit communicating with the first port of the second cylinder, a fourth conduit communicating with the second port of the second cylinder, and a steering mechanism turnable in opposite directions, the steering means pumping fluid through the third conduit in response to turning of the steering mechanism in one direction and pumping fluid through the fourth conduit in response to turning of the steering mechanism in the opposite direction.

IN THE DRAWINGS

Figure 1:
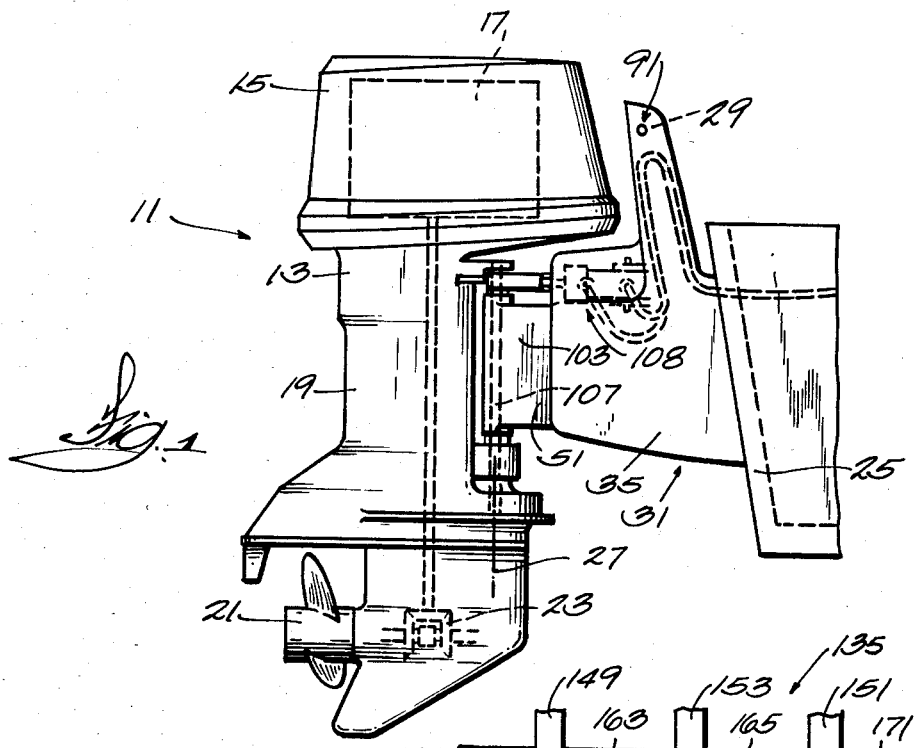
FIG. 1 is a side elevational view, partially broken away and in section, of a marine propulsion device incorporating various of the features of the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Shown in the drawings is a marine propulsion device which is in the form of an outboard motor 11 and which includes a generally conventional propulsion unit 13 incorporating a power head 15 with an internal combustion engine 17. The propulsion unit 13 also includes a lower unit 19 incorporating a rotatably mounted propeller 21 drivingly connected to the engine 17 through a selectively operable reversing transmission 23.

The marine propulsion device also includes means connecting the propulsion unit 13 to the rear of a boat transom 25 for pivotal movement of the propulsion unit 13 relative to the boat transom 25 about a steering axis 27, and, in the preferred embodiment, for pivotal movement of the propulsion unit 13 relative to the transom 25 about a horizontal tilt axis 29.

Thus, while other connecting means could be employed, in the preferred embodiment, the outboard motor 11 also includes a mounting assembly 31 for mounting the propulsion unit 13 to the boat transom 25 such that the propulsion unit 13 is vertically swingable between a lowermost running position with the propeller 21 submerged in water and a fully raised position with the propeller 21 out of the water. In the illustrated construction, the propulsion unit mounting assembly 31 comprises a transom bracket assembly 35 including a mounting portion adapted to be secured, by bolts of other suitable means, to the boat transom 25, and a pair of laterally spaced arms extending upwardly from the mounting portion and including an upper end having means for pivotally mounting a swivel bracket assembly 51 for swinging movement of the swivel bracket assembly 51 about the horizontal tilt axis 29.

While other arrangements could be employed, the means pivotally mounting the swivel bracket assembly 51 from the transom bracket assembly 35 comprises a suitable tilt pin 91 extending horizontally through the upper ends of the arms of the transom bracket assembly 35 and through the upper end of the swivel bracket assembly 51.

While other constructions could be employed, in the illustrated construction, the swivel bracket assembly 51 comprises a U-shaped assembly which provides a swivel block or member 103 which includes a vertical bore adapted to receive a king pin 107 fixed to and forming a part of the propulsion unit 13. The longitudinal axis of the king pin 107 is also the steering axis 27 of the propulsion unit 13.

The propulsion unit 13, as previously explained, is generally of conventional construction and includes the before mentioned king pin 107 which extends through the swivel block bore and which is suitably fixedly connected at the top and bottom, preferably through suitable rubber mounts (not shown), to the propulsion unit 13 so that rotary king pin movement in the swivel bracket bore effects steering movement of the propulsion unit 13 about the steering axis 27.

It should be noted that the transom bracket assembly 35, swivel bracket assembly 51, and king pin 107 fixed to the propulsion unit 13 are merely the preferred means for connecting the propulsion unit 13 to the boat transom 25 for pivotal movement of the propulsion unit 13 relative to the boat transom 25 about a steering axis. However, any suitable means for making this connection is within the scope of the invention. For instance, such means need not include means connecting the propulsion unit 13 to the boat transom 25 for pivotal movement of the propulsion unit 13 about the horizontal tilt axis 29.

Figure 2:
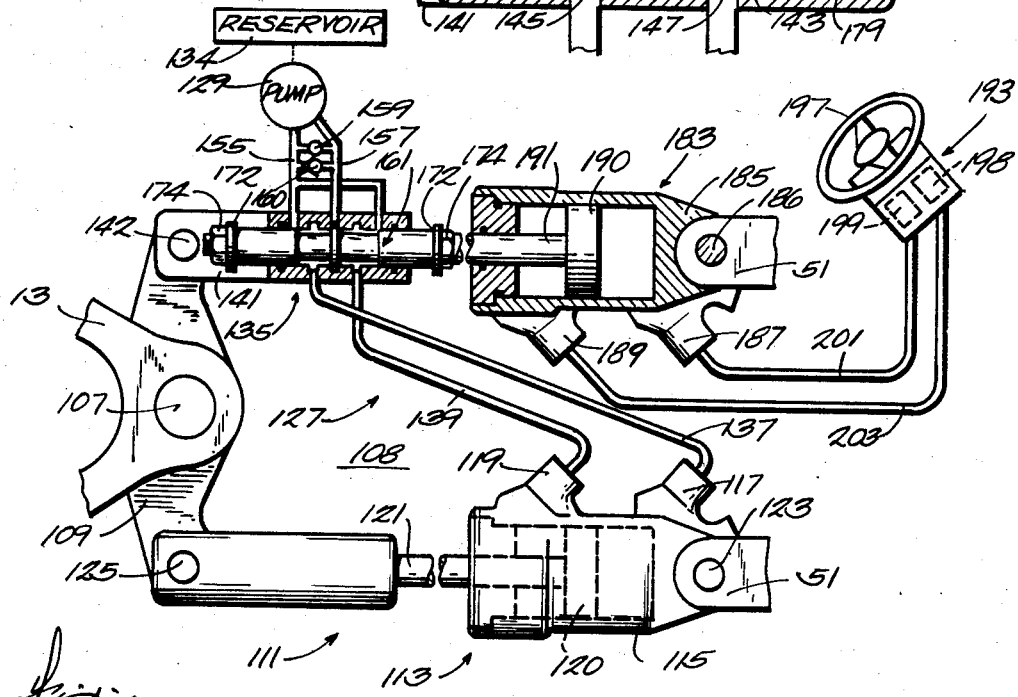
FIG. 2 is a schematic view of the hydraulic control circuit incorporated in the marine propulsion device shown in FIG. 1.

The marine propulsion device also includes means for rotating the propulsion unit 13 about the steering axis 27. While various suitable means could be employed, in the preferred embodiment, this means includes steering means 108 for effecting steering movement of the propulsion unit 13 relative to the swivel bracket assembly 51. In the preferred and illustrated construction, as best shown in FIG. 2, such means comprises an extendible and contractable steering link 111 that is, in the preferred embodiment, pivotally connected to the swivel bracket assembly 51 and to the propulsion unit 13. However, in an embodiment that does not include a swivel bracket assembly, the steering link 111 would instead be pivotally connected to the boat transom 25.

The steering means 108 also comprises a steering arm 109 fixedly attached to the king pin 107 for rotation therewith about the steering axis 27, the steering arm 109 having opposite first end and second ends and being attached to the king pin 107 at a point intermediate the opposite ends.

Preferably, the extendible and contractable steering link 111 is in the form of a hydraulic cylinder-piston assembly 113, which, at one end, is pivotally connected to a vertically extending stud 123 supported on the swivel bracket assembly 51, and which, at the other end, is pivotally connected to a stud 125 extending from the first end of the steering arm 109. It should be noted that, in alternative embodiments, the hydraulic cylinder-piston assembly 113 can be connected directly to the propulsion unit (preferably through suitable rubber mounts) rather than to a steering arm. In such embodiments, the propulsion unit is pivotally mounted on the swivel bracket assembly or boat transom for movement about the steering axis. For example, the propulsion unit can be pivotally mounted on a king pin that is fixed to the swivel bracket assembly.

More particularly, the hydraulic cylinder-piston assembly 113 comprises a hydraulic cylinder 115 having one end pivotally connected to the stud 123, and having opposed fluid ports 117 and 119. The hydraulic assembly 113 also comprises a piston 120 that moves reciprocally within the cylinder 115 in response to fluid entering the fluid ports 117 and 119, and a piston rod 121 extending from the other end of the cylinder 115 and having one and fixedly attached to the piston 120 and another end pivotally connected to the stud 125. The piston rod 121 extends in response to fluid entering port 117 of the cylinder 115 and retracts in response to fluid entering port 119 of the cylinder 115.

Accordingly, contraction or expansion of the hydraulic cylinder-piston assembly 113 will cause responsive movement of the first end of the steering arm 109, thereby causing rotation of the king pin 107, and thereby effecting steering movement of the propulsion unit 13 relative to the swivel bracket assembly 51 and therefore relative to the boat transom 25.

The steering means 108 further includes means for selectively and alternatively extending and contracting the steering link 111, the means including operator actuated extendible and contractable control means 127 connected to the propulsion unit 13 and to the boat transom 25. In the preferred embodiment, the control means 127 is connected to the second end of the steering arm 109 and to the swivel bracket assembly 51. The control means 127 is also operably connected to the steering link 111 for selectively effecting extension and contraction of the steering link 111 in response to operator actuation of the control means 127. It should be noted that, in an embodiment that does not include a swivel bracket assembly, the operator actuated extendible and contractable control means 127 would be connected directly to the boat transom 25 rather than to the swivel bracket assembly 51.

In the preferred embodiment, the control means 127 controls the supplying of hydraulic fluid to the fluid ports 117 and 119 and the draining of hydraulic fluid from the fluid ports 117 and 119.

While the other suitable control means could be used, in the illustrated construction, the control means 127 includes hydraulic control means comprising a first fluid pump 129 having inlet and outlet ports, a fluid reservoir 124, and valve means 135 communicating with the pump 129 and with a first conduit 137 communicating with the port 117 of the hydraulic cylinder 115 and a second conduit 139 communicating with the port 119 of the hydraulic cylinder 115.

Also, in the preferred embodiment, the pump 129, which is shown schematically in FIG. 2, is mounted on the outboard motor 11 and can be driven by the engine 17 or can be electrically operated. It should be noted, however, that any suitable location and driving means is within the scope of the invention.

Figure 3:
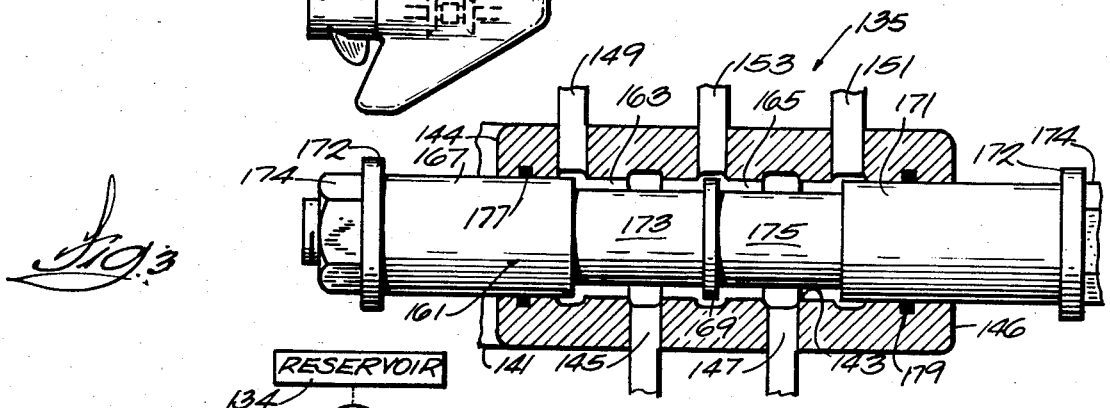
FIG. 3 is an enlarged cross-sectional view of the valve means shown in FIG. 2.

While other suitable valve means could be employed, in the preferred embodiment, the valve means 135, as best shown in FIGS. 2 and 3, comprises a valve housing 141 having one end pivotally connected to a stud 142 extending from the second end of the steering arm 109. The opposite end of the valve housing 141 includes a chamber portion having walls of substantially increased thickness, thus forming an elongated cylindrical chamber 143. The ends of the valve chamber 143 include end surfaces 144 and 146.

The valve housing 141 also includes spaced apart steering ports 145 and 147 on one side of the chamber 143, the ports 145 and 147 being in communication with the first and second conduits 137 and 139, respectively. The valve housing 141 further includes, on the opposite side of the chamber, three spaced-apart ports, two return ports 149 and 151 and an inlet port 153. The two return ports 149 and 151 are spaced opposite one another outside of the two steering ports 145 and 147, and the inlet port 153 is inside of the two steering ports 145 and 147. The two return ports 149 and 151 communicate by means of a conduit 155 with the inlet of the pump 129, and the inlet port 153 communicates by means of a conduit 157 with the outlet of the pump 129. In the preferred embodiment, as illustrated in FIG. 2, the valve means 135 also includes a pressure relief valve 159 and a check valve 160 communicating between conduits 155 and 157.

The valve means 135 further comprises a movable valve member 161 defining two movable smaller chambers 163 and 165 in the housing chamber 143. The valve member 161 includes three spaced-apart coaxial solid cylindrical portions 167, 169, and 171 connected to one another by two smaller diameter connecting rods 173 and 175. The valve member 161 is snugly received in the housing chamber 143, and the three spaced-apart cylindrical portions 167, 169, and 171 serve to divide the housing chamber 143 into the two movable smaller chambers 163 and 165, with the intermediate solid cylindrical portion 169 separating the two chambers 163 and 165. The two outer cylindrical portions 167 and 171 engage sealing means 177 and 179 respectively on the inner surface of the housing chamber 143 for effectively sealing the movable smaller chambers 163 and 165.

Connected to the opposite ends of valve member 161, or to the outside ends of cylindrical portions 167 and 171, are washers 172, the reason for which will be explained later. The washers 172 have a diameter greater than the diameter of cylindrical portions 167 and 171. In the illustrated construction, the washers 172 are secured to the valve member 161 by nuts 174.

The valve member 161 is movable relative to the valve housing 141 between three positions for operating the valve means 135. When the valve member 161 is not being moved, extension or retraction of the piston rod 121 causes the valve housing 141 to move axially relative to the valve member 161, since the valve housing 141 is pivotally connected to the second end of the steering arm 109, and the piston rod 121 is pivotally connected to the first end of the steering arm 109.

In the first position, the valve member 161 is to the right side of the housing chamber 143 as shown in FIG. 2, and the movable smaller chambers 163 and 165 permit fluid to pass from inlet port 153 to steering port 145, and from steering port 147 to return port 151. In addition, the left cylindrical portion 167 closes return port 149, and the intermediate cylindrical portion 169 separates inlet port 153 from steering port 147.

In the second position, the valve member 161 is to the left side of the housing chamber 143 as shown in FIG. 2, and the movable smaller chambers 163 and 165 permit fluid to pass from inlet port 153 to steering port 147, and from steering port 145 to return port 149. In addition, the right cylindrical portion 171 closes return port 151, and the intermediate cylindrical portion 169 separates inlet port 153 from steering port 145. The valve member 161 thus serves to reverse the fluid connection between the pump 129 and the conduits 137 and 139.

In the third position, which is the position shown in FIGS. 2 and 3, the valve member 161 is in the middle of the housing chamber 143. The left cylindrical portion 167 partially closes return port 149, the intermediate cylindrical portion 169 partially closes inlet port 153, and the right cylindrical portion 171 partially closes return port 151. Pressurized hydraulic fluid flows through inlet port 153 and past the opposite edges of intermediate cylindrical portion 169 into both movable smaller chambers 163 and 165. The fluid port 117 of the cylinder 115 is in fluid communication with chamber 163 via conduit 137 and steering port 145. The fluid port 119 of the cylinder 115 is in fluid communication with chamber 165 via conduit 139 and steering port 147. Thus, both sides of the piston 120 are exposed to pressurized fluid when the valve member 161 is in the third position.

In the true third position, the intermediate cylindrical portion 169 is not exactly centered with respect to the inlet port 153, because the area of the side of the piston 120 facing the port 117 is larger than the area of the side facing the port 119 by virtue of the area occupied by the piston rod 121. If the cylindrical portion 169 is exactly centered, the pressure supplied to fluid ports 117 and 119 will be equal, and, because of the larger area of the one side of the piston 120, the piston rod 121 will extend and move the valve housing 141 to the right as viewed in FIG. 3 relative to the valve member 161 until the pressures acting on the opposite sides of the piston 120 produce substantially equal pressure forces on both sides of the piston 120. In other words, the valve member 161 moves to the true third position, i.e., the size of the opening between the left edge of the intermediate cylindrical portion 169 and the inlet port 153 is reduced, thereby reducing the hydraulic pressure supplied to the fluid port 117, while the size of the opening between the right edge of the intermediate cylindrical portion 169 and the inlet port 153 is increased, thereby increasing the hydraulic pressure supplied to the fluid port 119.

External forces acting upon the propulsion unit 13 tending to pivot it about the steering axis 27 are resisted in a similar manner. For example, a force tending to pivot the propulsion unit 13 clockwise as viewed in FIG. 2 would move the valve housing 141 to the right and increase the opening between the right edge of the intermediate cylindrical portion 169 and the inlet port 153 while decreasing the opening between the left edge of the intermediate cylindrical portion 169 and the inlet port 153. This would increase the hydraulic pressure supplied to the port 119 of the cylinder 115 for resisting extension of the piston rod 121 to allow clockwise pivoting of the propulsion unit 13.

When the valve member 161 is in the third position, a portion of the hydraulic fluid flows from each of the movable chambers 163 and 165 out through return ports 149 and 151, respectively, and is returned to the pump 129 through conduit 155.

The control means 127 also includes operator actuated means for moving the valve member 161 relative to the valve housing 141. While other operator actuated means could be used, the operator actuated means of the preferred embodiment includes hydraulic activating means 183 including a hydraulic cylinder 185 having one end connected to a stud 186 extending from the swivel bracket 51, and having first and second fluid ports 187 and 189.

The hydraulic activating means 183 also includes a piston 190 that moves reciprocally within the cylinder 185 in response to fluid entering ports 187 and 189, and a piston rod 191 extending from the other end or rod end of the hydraulic cylinder 185. The piston rod 191 has an inner end fixedly attached to the piston 190 and an outer end connected to the valve member 161 of the valve means 135. In the illustrated construction, the outer end of the piston rod 191 extends through the valve member 161 and has threaded portions adjacent either end of the valve member 161 onto which the nuts 174 are threaded. The piston rod 191 extends in response to fluid entering the first port 187 of the hydraulic cylinder 185 and retracts in response to fluid entering the second port 189 of the hydraulic cylinder 185.

The operator actuated means also includes operator actuated helm means 193 (shown schematically in FIG. 2) including a steering wheel 197, a fluid reservoir 198, and a pump 199. The pump pumps fluid through a third conduit 201 communicating with the first port 187 of the hydraulic cylinder 185 in response to rotation of the steering wheel 197 in one direction, and pumps fluid through a fourth conduit 203 communicating with the second port 189 of the hydraulic cylinder 185 in response to rotation of the steering wheel 197 in the opposite direction. Such a helm is conventional and need not be described in greater detail.

In operation, when the steering wheel 197 is centered, the helm means 193 pumps fluid through neither of the third and fourth conduits 201 and 203. Therefore, fluid enters neither of the ports 187 and 189 of the hydraulic cylinder 185, and the piston rod 191 is maintained in the neutral or centered position. When the steering wheel 197 is turned to the right, the helm means 193 pumps fluid through the third conduit 201 to the port 187 of the hydraulic cylinder 185. The fluid entering the port 187 causes the piston rod 191 to extend from the cylinder 185. When the steering wheel 197 is turned to the left, the helm mean 193 pumps fluid through the fourth conduit 203 to the port 189 of the cylinder 185. The fluid entering the port 189 causes the piston rod 191 to retract into the cylinder 185.

In operation, the steering means 108 functions as follows. Starting with the steering wheel 197 centered and the propulsion unit 13 in the straight ahead position, no fluid enters either of the ports 187 and 189 of the hydraulic cylinder 185. Thus, the piston rod 191 is maintained in the centered position, and the valve member 161 is in the third position relative to the valve housing 141, so that that piston rod 121 is maintained in the neutral or centered position relative to the cylinder 115, as explained above. With the piston rod 121 in the neutral position, the first end of the steering arm 109 is also in the neutral position, so that the steering arm 109 maintains the king pin 107, and therefore the propulsion unit 13, in the straight ahead position.

When the steering wheel 197 is turned to the right, the piston rod 191 extends from the cylinder 185, as explained above. This causes the valve member 161 to move from the third position to the second position relative to the valve housing 141.

With the valve member 161 in the second position, inlet port 153 communicates with steering port 147, and return port 149 communicates with steering port 145. This allows fluid to pass from the pump 129 through conduit 157 to inlet port 153, through the valve means 135 to steering port 147, and then through conduit 139 to port 119 of hydraulic cylinder 115.

The fluid entering port 119 causes piston rod 121 to retract, which causes fluid to be forced out of the cylinder 115 through port 117. This fluid passes through conduit 137 to steering port 145, through the valve means 135 to return port 147, and then through conduit 155 to the inlet of the pump 129.

The retraction of piston rod 121 also causes the first end of the steering arm 109 to move forward (to the right in FIG. 2). This forward movement of the first end of the steering arm 109 causes rotation of the king pin 107 about the steering axis 27, which turns the propulsion unit 13 and the propeller 21 to the right for turning the boat to the right.

At the same time that the first end of the steering arm 109 is moving forward, the second end of the steering arm 109 is moving backward (to the left in FIG. 2). This causes backward movement of the valve housing 141 relative to the valve member 161, which causes the valve member 161 to return to the third position relative to the valve housing 141. This maintains the piston rod 121 in the retracted position, as explained above, which causes the propulsion unit 13 to be maintained in the right turn position.

When the steering wheel 197 is returned to the centered or straight ahead position, the helm mean 193 pumps fluid through the fourth conduit 203 to the port 189 of the hydraulic cylinder 185. The fluid entering the port 189 causes the piston rod 191 to retract and return to the centered position, which causes the valve member 161 to move from the third position to the first position relative to the valve housing 141.

With the valve member 161 in the first position, inlet port 153 communicates with steering port 145, and return port 151 communicates with steering port 147. This allows fluid to pass from the pump 129 through conduit 157 to inlet port 153, through the valve means 135 to steering port 145, and then through conduit 137 to port 117 of cylinder 115.

The fluid entering port 117 causes piston rod 121 to extend back to the neutral position, which causes fluid to be forced out of the cylinder 115 through port 119. This fluid passes through conduit 139 to steering port 147, through the valve means 135 to return port 151, and then through conduit 155 to the inlet of the pump 129.

The extension of piston rod 121 also causes the first end of the steering arm 109 to move backward (to the left in FIG. 2). This backward movement of the first end of the steering arm 109 causes rotation of the king pin 107 about the steering axis 27, which returns the propulsion unit 13 and the propeller 21 to the straight ahead position.

At the same time that the first end of the steering arm 109 is moving backward, the second end of the steering arm 109 is moving forward (to the right in FIG. 2). This causes forward movement of the valve housing 141 relative to the valve member 161, which causes the valve member 161 to return from the first position to the third position relative to the valve housing 141. This maintains the piston rod 121 in the neutral position, as explained above, which causes the propulsion unit 13 to be maintained in the straight ahead position.

The steering means 108 operates in the reverse fashion for left turns.

The steering means 108 also provides for "manual" back up steering in the event of failure of the hydraulic cylinder-piston assembly 113, the pump 129, or the valve means 135. This "manual" back up steering is not truly manual since it still relies on the functioning of the helm means 193 and the hydraulic activating means 183.

When a failure occurs, movement of the valve member 161 relative to the valve housing 141 will not result in extension or contraction of the piston rod 121 and steering movement of the propulsion unit 13. However, movement of the valve member 161 will in this case cause movement of the valve housing 141, which will then move the second end of the steering arm 109 for steering movement, as explained below.

When a right turn is made, the piston rod 191 extends, and the valve member 161 moves backwardly (to the left in FIG. 2) relative to the valve housing 141. If this movement does not result in the normal retraction of the piston rod 121 to steer the propulsion unit 13 to the right, then the washer 172 connected to the outside end of cylindrical portion 171 will engage the end surface 146 of the chamber portion of the valve housing 141. Further extension of piston rod 191 in response to turning of the steering wheel 197 will cause the valve housing 141 to move backwardly, thereby moving the second end of the steering arm 109 backwardly and turning the propulsion unit 13 to the right.

When a similar failure occurs during a left turn, the washeer 172 connected to the outside end of cylindrical portion 167 will engage the end surface 144, thereby causing the valve housing 141 to move forwardly in response to contraction of the piston rod 191. This will move the second end of the steering arm 109 forwardly, thereby turning the propulsion unit 13 to the left.

In the event that manual steering is necessary due to failure of the pump 129, the check valve 160 allows the manual steering to be effected without forcing hydraulic fluid through the failed pump 129. Since manual movement of the second end of the steering arm 109 to turn the propulsion unit 13 will also cause extension or contraction of the piston rod 121, fluid will be forced through the valve means 135 and out one of the return ports 149 and 151 to conduit 155.

Check valve 160 allows this fluid to bypass the failed pump 129. Check valve 160 allows fluid flow only in the direction from conduit 155 to conduit 157 and is normally held closed, when pump 129 is working, by pressure from pump 129 in conduit 157. However, when pump 129 is not working, fluid passes from conduit 155 through check valve 160 to conduit 157, thereby bypassing the pump 129.

Figure 4:
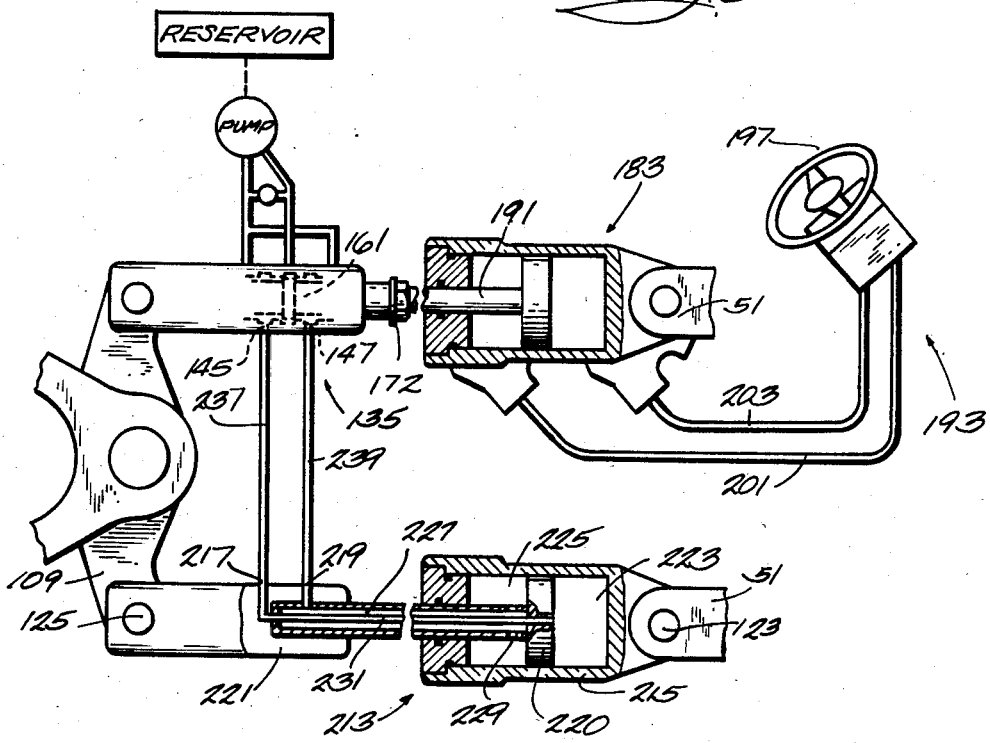
FIG. 4 is a schematic view of an alternative embodiment of the hydraulic steering link of the invention.

Illustrated in FIG. 4 is an alternative embodiment of the hydraulic cylinder-piston assembly of the steering link. In the alternative embodiment, the steering link is in the form of hydraulic cylinder-piston assembly 213, which, at one end, is pivotally connected to the vertically extending stud 123 supported on the swivel bracket assembly 51, and which, at the other end, is pivotally connected to the stud 125 extending from the first end of the steering arm 109.

More particularly, the hydraulic cylinder-piston assembly 213 comprises a hydraulic cylinder 215 having first and second closed ends, the first end being pivotally connected to the stud 123. The hydraulic assembly 213 also comprises a piston 220 that moves reciprocally within the cylinder 215 and that divides the cylinder 215 into opposed first and second pressure chambers 223 and 225, respectively.

The hydraulic assembly 213 further comprises a piston rod 221 extending through the second end of the cylinder 215 and having a first end fixedly attached to the piston 220 and a second end pivotally connected to the stud 125. The piston rod 221 extends in response to fluid entering the first pressure chamber 223 and retracts in response to fluid entering the second pressure chamber 225.

The piston rod 221 also includes fluid ports 217 and 219 adjacent the second end of the piston rod 221, first passage means communicating between the fluid port 217 and the first pressure chamber 223, and second passage means communicating between the fluid port 219 and the second pressure chamber 225. While various suitable passage means could be employed, in the illustrated construction, the first passage means comprises a hollow interior portion 227 of the piston rod 221 extending from the piston 220 and communicating with the fluid port 219, and a port 229 located adjacent the piston 220 and communicating between the second pressure chamber 225 and the hollow interior portion 227. The second passage means comprises a tube 231 extending axially through the hollow interior portion 227 of the piston rod 221 and through the piston 220 and communicating between the first pressure chamber 223 and the fluid port 217.

In this alternative embodiment, as in the preferred embodiment illustrated in FIG. 2, a conduit 237 communicates between the steering port 145 and the fluid port 217, and a conduit 239 communicates between the steering port 147 and the fluid port 219. Thus, as in the preferred embodiment, fluid flowing through the steering port 145 to the hydraulic assembly 213 will cause the piston rod 221 to extend, and fluid flowing through the steering port 147 to the hydraulic assembly 213 will cause the piston rod 221 to retract.

The advantage of the alternative embodiment illustrated in FIG. 4 is that there is less flexing of the conduits (237 and 239 in FIG. 4) communicating between the valve means 135 and the steering link, because there is little relative movement between the valve means 135 and the piston rod 221.

In another alternative embodiment, which is not illustrated, the hydraulic cylinder-piston assembly 113 shown in FIG. 2 is modified so that the cylinder is connected to the steering arm and the piston rod is connected to the swivel bracket. In this embodiment, as in the embodiment illustrated in FIG. 4, the conduits communicating between the valve means (135 in FIG.

4) and the hydraulic cylinder-piston assembly are shorter and undergo less flexing.

Figure 5:
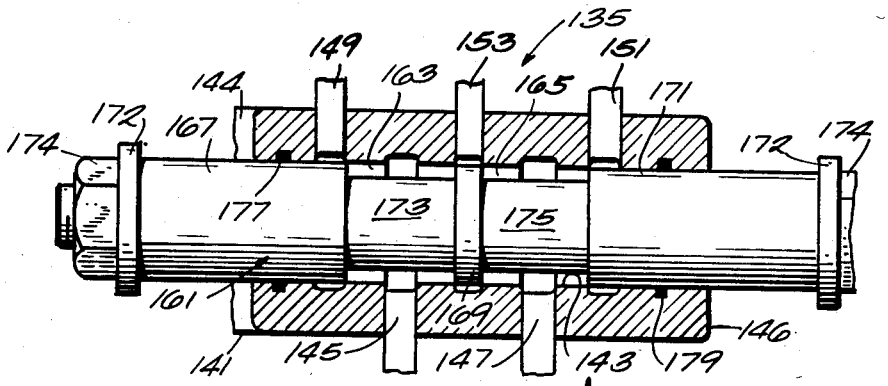
FIG. 5 is an enlarged cross-sectional view of an alternative construction of the valve means shown in FIG. 3.

Illustrated in FIG. 5 is an alternative construction of the valve means 135. Components corresponding to those of the valve means 135 shown in FIG. 3 are designated by the same reference numeral.

In this alternative construction, valve member 161 is constructed so that, in the third position, the left cylindrical portion 167 closes return port 149, the intermediate cylindrical portion 169 closes inlet port 153, and the right cylindrical portion 171 closes return port 151. Thus, in the third position, the valve member 161 serves to prevent fluid flow between the pump 129 and the conduits 137 and 139, because the movable smaller chambers 163 and 165 are not in communication with any of the valve ports 149, 151, and 153. Therefore, when the valve member 161 is in the third position, the piston 120 and piston rod 121 are locked in position because no fluid can flow into or out of either of the ports 117 and 119 of the cylinder 115.

Other than this difference, the alternative valve means 135 operates in substantially the same manner as valve means 135 of FIG. 3.

Various of the features of the invention are set forth in the following claims.

I claim:

1. A marine propulsion device adapted for mounting to a boat transom and comprising a propulsion unit, means connecting said propulsion unit to the boat transom for pivotal movement of said propulsion unit relative to the boat transom about a steering axis, and means for rotating said propulsion unit about said steering axis, said means including an extendible and contractable steering link pivotally connected to the boat transom and to said propulsion unit, and means for selectively extending and contracting said steering link, said means including operator actuated extendible and contractable control means connected to the boat transom and to said propulsion unit and operably connected to said steering link for selectively effecting extension and contraction of said steering link in response to operator actuation of said control means.

2. A marine propulsion device in accordance with claim 1 wherein said control means comprises a first member pivotally connected to said propulsion unit, a second member pivotally connected to the boat transom, said second member being movably connected to said first member and being movable relative to said first member between first, second, and third positions, and operator actuated means for moving said second member relative to said first member, and wherein said control means causes said link to extend when said second member is in said first position, causes said link to contract when said second member is in said second position, and causes said link to neither extend nor contract when said second member is in said third position.

3. A marine propulsion device in accordance with claim 1 wherein said steering link comprises extendible and contractable hydraulic steering means having one end pivotally connected to said propulsion unit and an opposite end pivotally connected to the boat transom and having first and second fluid ports, said hydraulic steering means extending in response to fluid entering said first port and contracting in response to fluid entering said second port, and wherein said control means controls the supplying of hydraulic fluid to said first and second ports and the draining of hydraulic fluid from said first and second ports.

4. A marine propulsion device in accordance with claim 3 wherein said control means comprises a first source of fluid under pressure, valve means communicating with said first fluid source and comprising a first conduit communicating with said first port of said hydraulic steering means, a second conduit communicating with said second port of said hydraulic steering means, a valve housing pivotally connected to said propulsion unit, and a valve member housed in said valve housing and movable relative to said valve housing between first, second and third positions, said valve means providing communication of said first fluid source with said first conduit when said valve member is in said first position, providing communication of said first fluid source with said second conduit when said valve member is in said second position, and providing communication of said first fluid source with both of said first and second conduits when said valve member is in said third position, and operator actuated means for moving said valve member relative to said valve housing.

5. A marine propulsion device in accordance with claim 3 wherein said control means comprises a first source of fluid under pressure, valve means communicating with said first fluid source and comprising a first conduit communicating with said first port of said hydraulic steering means, a second conduit communicating with said second port of said hydraulic steering means, a valve housing pivotally connected to said propulsion unit, and a valve member housed in said valve housing and movable relative to said valve housing between first, second and third positions, said valve means providing communication of said first fluid source with said first conduit when said valve member is in said first position, providing communication of said first fluid source with said second conduit when said valve member is in said second position, and providing communication of said first fluid source with neither of said first and second conduits when said valve member is in said third position, and operator actuated means for moving said valve member relative to said valve housing.

6. A marine propulsion device adapted for mounting to a boat transom and comprising a propulsion unit, means connecting said propulsion unit to the boat transom for pivotal movement of said propulsion unit relative to the boat transom about a steering axis, and means for rotating said propulsion unit about said steering axis, said means including a steering arm fixedly attached to said propulsion unit for rotation therewith about said steering axis, said steering arm having opposite first and second ends and being attached to said propulsion unit at a point on said steering arm intermediate said opposite ends, an extendible and contractable steering link pivotally connected to said first end of said steering arm and to the boat transom, and means for selectively extending and contracting said link, said means including operator actuated extendible and contractable control means connected to said second end of said steering arm and to the boat transom and operably connected to said link for selectively effecting extension and contraction of said steering link in response to operator actuation of said control means.

7. A marine propulsion device in accordance with claim 6 wherein said control means comprises a first member pivotally connected to said second end of said steering arm, a second member pivotally connected to the boat transom, said second member being movably connected to said first member and being movable relative to said first member and being movable relative to said first member between first, second, and third positions, and operator actuated means for moving said second member relative to said first member, said control means causing said link to extend when said second member is in said first position, causing said link to contract when said second member is in said second position, and causing said link to neither extend nor contract when said second member is in said third position.

8. A marine propulsion device in accordance with claim 6 wherein said steering link comprises extendible and contractable hydraulic steering means having one end pivotally connected to said first end of said steering arm and an opposite end pivotally connected to the boat transom and having first and second fluid ports, said hydraulic steering means extending in response to fluid entering said first port and contracting in response to fluid entering said second port, and wherein said control means controls the supplying of hydraulic fluid to said first and second ports and the draining of hydraulic fluid from said first and second ports.

9. A marine propulsion device in accordance with claim 8 wherein said control means comprises a first source of fluid under pressure, valve means communicating with said first fluid source and comprising a first conduit communicating with said first port of said hydraulic steering means, a second conduit communicating with said second port of said hydraulic steering means, a valve housing pivotally connected to said second end of said steering arm, and a valve member housed in said valve housing and movable relative to said valve housing between first, second and third positions, said valve means providing communication of said first fluid source with said first conduit when said valve member is in said first position, providing communication of said first fluid source with said second conduit when said valve member is in said second position, and providing communication of said first fluid source with both of said first and second conduits when said valve member is in said third position, and operator actuated means for moving said valve member relative to said valve housing.

10. A marine propulsion device in accordance with claim 9 wherein said operator actuated means comprises hydraulic activating means having one end connected to said valve member and an opposite end connected to the boat transom and having first and second fluid ports, said hydraulic activating means moving said valve member toward said first position relative to said valve housing in response to fluid entering said first port and moving said valve member toward said second position relative to said valve housing in response to fluid entering said second port, and operator actuated steering means including a second fluid source, pump means communicating with said second fluid source, a third conduit communicating with said pump means and with said first port of said hydraulic activating means, a fourth conduit communicating with said pump means and with said second port of said hydraulic activating means, and a steering mechanism operably connected to said pump means and turnable in opposite directions, said operator actuated steering means pumping fluid through said third conduit in response to turning of said steering mechanism in one direction and pumping fluid through said fourth conduit in response to turning of said steering mechanism in the opposite direction.

11. A marine propulsion device in accordance with claim 8 wherein said control means comprises a first source of fluid under pressure, valve means communicating with said first fluid source and comprising a first conduit communicating with said first port of said hydraulic steering means, a second conduit communicating with said second port of said hydraulic steering means, a valve housing pivotally connected to said second end of said steering arm, and a valve member housed in said valve housing and movable relative to said valve housing between first, second and third positions, said valve means providing communication of said first fluid source with said first conduit when said valve member is in said first position, providing communication of said first fluid source with said second conduit when said valve member is in said second position, and providing communication of said first fluid source with neither of said first and second conduits when said valve member is in said third position, and operator actuated means for moving said valve member relative to said valve housing.

12. A marine propulsion device in accordance with claim 11 wherein said operator actuated means comprises hydraulic activating means having one end connected to said valve member and an opposite end connected to the boat transom and having first and second fluid ports, said hydraulic activating means moving said valve member toward said first position relative to said valve housing in response to fluid entering said first port and moving said valve member toward said second position relative to said valve housing in response to fluid entering said second port, and operator actuated steering means including a second fluid source, pump means communicating with said second fluid source, a third conduit communicating with said pump means and with said first port of said hydraulic activating means, a fourth conduit communicating with said pump means and with said second port of said hydraulic activating means, and a steering mechanism operably connected to said pump means and turnable in opposite directions, said operator actuated steering means pumping fluid through said third conduit in response to turning of said steering mechanism in one direction and pumping fluid through said fourth conduit in response to turning of said steering mechanism in the opposite direction.

13. A marine propulsion device in accordance with claim 6 wherein said means connecting said propulsion unit to the boat transom includes a swivel bracket, means connecting said swivel bracket to the boat transom for pivotal movement of said swivel bracket relative to the boat transom about a horizontal tilt axis, and means connecting said propulsion unit to said swivel bracket for common movement of said propulsion unit with said swivel bracket about said tilt axis and for pivotal movement of said propulsion unit relative to said swivel bracket about said steering axis.

14. A marine propulsion device in accordance with claim 13 wherein said means connecting said propulsion unit to said swivel bracket includes a king pin extending in said swivel bracket and fixed to said propulsion unit, and wherein said steering arm is fixedly attached to said king pin.

15. A marine propulsion device adapted for mounting to a boat transom and comprising a swivel bracket, means connecting said swivel bracket to the boat transom for pivotal movement of said swivel bracket relative to the transom about a horizontal tilt axis, a propulsion unit, means connecting said propulsion unit to said swivel bracket for common movement of said propulsion unit with said swivel bracket about said tilt axis and for pivotal movement of said propulsion unit relative to said swivel bracket about a steering axis transverse to said tilt axis, said means connecting said propulsion unit to said swivel bracket including a king pin extending in said swivel bracket and fixed to said propulsion unit for rotation therewith about said steering axis, and means for rotating said king pin about said steering axis, said means including a steering arm fixedly attached to said king pin for rotation therewith about said steering axis, said steering arm having opposite first and second ends and being attached to said king pin at a point on said steering arm intermediate said opposite ends, extendible and contractable hydraulic steering means having one end pivotally connected to said swivel bracket and an opposite end pivotally connected to said first end of said steering arm and having first and second fluid ports, said hydraulic steering means extending in response to fluid entering said first port and contracting in response to fluid entering said second port, and means for selectively extending and contracting said hydraulic steering means, said means includng extendible and contractable control means connected between said swivel bracket and said second end of said steering arm and operably connected to said hydraulic steering means for selectively controlling the supplying of hydraulic fluid to said first and second ports and the draining of hydraulic fluid from said first and second ports.

16. A marine propulsion device in accordance with claim 15 wherein said hydraulic steering means comprises a hydraulic cylinder pivotally connected to said swivel bracket and having said first and second fluid ports, and a piston rod having one end slidably received in said cylinder and an opposite end pivotally connected to said first end of said steering arm, said piston rod extending in response to fluid entering said first port and retracting in response to fluid entering said second port.

17. A marine propulsion device in accordance with claim 16 wherein said control means comprises a first source of fluid under pressure, valve means communicating with said first fluid source and comprising a first conduit communicating with said first port of said hydraulic cylinder, a second conduit communicating with said second port of said hydraulic cylinder, a valve housing pivotally connected to said second end of said steering arm, and a valve member housed in said valve housing and movable relative to said valve housing between first, second and third positions, said valve means providing communication of said first fluid source with said first conduit when said valve member is in said first position, providing communication of said first fluid source with said second conduit when said valve member is in said second position, and providing communication of said first fluid source with both of said first and second conduits when said valve member is in said third position, and operator actuated means for moving said valve member relative to said valve housing.

18. A marine propulsion device in accordance with claim 17 wherein said operator actuated means comprises hydraulic activating means comprising a second hydraulic cylinder connected to said swivel bracket and having first and second fluid ports, and a second piston rod having one end slidably received in said second cylinder and an opposite end connected to said valve member, said second piston rod extending in response to fluid entering said first port of said second cylinder and retracting in response to fluid entering said second port of said second cylinder, and operator actuated steering means including a second fluid source, pump means communicating with said second fluid source, a third conduit communicating with said pump means and with said first port of said second cylinder, a fourth conduit communicating with said pump means and with said second port of said second cylinder, and a steering mechanism operably connected to said pump means and turnable in opposite directions, said steering means pumping fluid through said third conduit in response to turning of said steering mechanism in one direction and pumping fluid through said fourth conduit in response to turning of said steering mechanism in the opposite direction.

19. A marine propulsion device in accordance with claim 16 wherein said control means comprises a first source of fluid under pressure, valve means communicating with said first fluid source and comprising a first conduit communicating with said first port of said hydraulic cylinder, a second conduit communicating with said second port of said hydraulic cylinder, a valve housing pivotally connected to said second end of said steering arm, and a valve member housed in said valve housing and movable relative to said valve housing between first, second and third positions, said valve means providing communication of said first fluid source with said first conduit when said valve member is in said first position, providing communication of said first fluid source with said second conduit when said valve member is in said second position, and providing communication of said first fluid source with neither of said first and second conduits when said valve member is in said third position, and operator actuated means for moving said valve member relative to said valve housing.

20. A marine propulsion device in accordance with claim 19 wherein said operator actuated means comprises hydraulic activating means comprising a second hydraulic cylinder connected to said swivel bracket and having first and second fluid ports, and a second piston rod having one end slidably received in said second cylinder and an opposite end connected to said valve member, said second piston rod extending in response to fluid entering said first port of said second cylinder and retracting in response to fluid entering said second port of said second cylinder, and operator actuated steering means including a second fluid source, pump means communicating with said second fluid source, a third conduit communicating with said pump means and with said first port of said hydraulic activating means, a fourth conduit communicating with said pump means and with said second port of said hydraulic activating means, and a steering mechanism operably connected to said pump means and turnable in opposite directions, said operator actuated steering means pumping fluid through said third conduit in response to turning of said steering mechanism in one direction and pumping fluid through said fourth conduit in response to turning of said steering mechanism in the opposite direction.

21. A marine propulsion device in accordance with claim 15 wherein said hydraulic steering means comprises a cylinder having first and second closed ends, said first end being pivotally connected to said swivel bracket, a piston movable in said cylinder and dividing said cylinder into a first pressure chamber adjacent said first end of said cylinder and a second pressure chamber adjacent said second end of said cylinder, and a piston rod extending through said second end of said cylinder and having a first end fixedly attached to said piston and a second end pivotally connected to said first end of said steering arm, said piston rod including, adjacent said second end of said piston rod, said first and second fluid ports, and including passage means communicating between said first fluid port and said first pressure chamber, and passage means communicating between said second fluid port and said second pressure chamber.

22. A marine propulsion device in accordance with claim 21 wherein said control means comprises a first source of fluid under pressure, valve means communicating with said first fluid source and comprising a first conduit communicating with said first port of said piston rod, a second conduit communicating with said second port of said piston rod, a valve housing pivotally connected to said second end of said steering arm, and a valve member housed in said valve housing and movable relative to said valve housing between first, second and third positions, said valve means providing communication of said first fluid source with said first conduit when said valve member is in said first position, providing communication of said first fluid source with said second conduit when said valve member is in said second position, and providing communication of said first fluid source with both of said first and second conduits when said valve member is in said third position, and operator actuated means for moving said valve member relative to said valve housing.

23. A marine propulsion device in accordance with claim 22 wherein said operator actuated means comprises hydraulic activating means comprising a second hydraulic cylinder connected to said swivel bracket and having first and second fluid ports, and a second piston rod having one end slidably received in said second cylinder and an opposite end connected to said valve member, said second piston rod extending in response to fluid entering said first port of said second cylinder and retracting in response to fluid entering said second port of said second cylinder, and operator actuated steering means including a second fluid source, pump means communicating with said second fluid source, a third conduit communicating with said pump means and with said first port of said second cylinder, a fourth conduit communicating with said pump means and with said second port of said second cylinder, and a steering mechanism operably connected to said pump means and turnable in opposite directions, said steering means pumping fluid through said third conduit in response to turning of said steering mechanism in one direction and pumping fluid through said fourth conduit in response to turning of said steering mechanism in the opposite direction.

24. A marine propulsion device in accordance with claim 21 wherein said control means comprises a first source of fluid under pressure, valve means communicating with said first fluid source and comprising a first conduit communicating with said first port of said piston rod, a second conduit communicating with said second port of said piston rod, a valve housing pivotally connected to said second end of said steering arm, and a valve member housed in said valve housing and movable relative to said valve housing between first, second and third positions, said valve means providing communication of said first fluid source with said first conduit when said valve member is in said first position, providing communication of said first fluid source with said second conduit when said valve member is in said second position, and providing communication of said first fluid source with neither of said first and second conduits when said valve member is in said third position, and operator actuated means for moving said valve member relative to said valve housing.

25. A marine propulsion device in accordance with claim 24 wherein said operator actuated means comprises hydraulic activating means comprising a second hydraulic cylinder connected to said swivel bracket and having first and second fluid ports, and a second piston rod having one end slidably received in said second cylinder and an opposite end connected to said valve member, said second piston rod extending in response to fluid entering said first port of said second cylinder and retracting in response to fluid entering said second port of said second cylinder, and operator actuated steering means including a second fluid source, pump means communicating with said second fluid source, a third conduit communicating with said pump means and with said first port of said second cylinder, a fourth conduit communicating with said pump means and with said second port of said second cylinder, and a steering mechanism operably connected to said pump means and turnable in opposite directions, said steering means pumping fluid through said third conduit in response to turning of said steering mechanism in one direction and pumping fluid through said fourth conduit in response to turning of said steering mechanism in the opposite direction.

* * * * *